US009865277B2

(12) United States Patent
Faubel et al.

(10) Patent No.: US 9,865,277 B2
(45) Date of Patent: Jan. 9, 2018

(54) METHODS AND APPARATUS FOR DYNAMIC LOW FREQUENCY NOISE SUPPRESSION

(71) Applicant: Nuance Communications, Inc., Burlington, MA (US)

(72) Inventors: Friedrich Faubel, Ulm (DE); Patrick B. Hannon, Ulm (DE); Kai Wenzler, Neu-Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 0 days.

(21) Appl. No.: 14/775,815

(22) PCT Filed: Jul. 10, 2013

(86) PCT No.: PCT/US2013/049846

§ 371 (c)(1),
(2) Date: Sep. 14, 2015

(87) PCT Pub. No.: WO2015/005914

PCT Pub. Date: Jan. 15, 2015

(65) Prior Publication Data

US 2016/0019910 A1 Jan. 21, 2016

(51) Int. Cl.
*G10L 21/0232* (2013.01)
*G10L 25/18* (2013.01)

(52) U.S. Cl.
CPC ..... *G10L 21/0232* (2013.01); *G10L 25/18* (2013.01)

(58) Field of Classification Search
CPC ..... G10L 21/0208; G10L 21/02085; G10L 21/0232
See application file for complete search history.

(56) References Cited

U.S. PATENT DOCUMENTS 5,621,850 A * 4/1997 Kane ..... G10L 15/20 704/206
5,933,801 A * 8/1999 Fink ..... G10L 21/003 704/207
7,225,001 B1 5/2007 Eriksson et al.
2003/0166624 A1 9/2003 Gale et al.
2006/0104460 A1 5/2006 Behboodian et al.
2006/0166624 A1* 7/2006 Van Vugt ..... H04M 3/2236 455/67.11
2008/0281589 A1* 11/2008 Wang ..... G10L 21/0208 704/226

(Continued)

OTHER PUBLICATIONS

International Application No. PCT/US2013/049846, Notification Concerning Transmittal of International Preliminary Report on Patentability (Chapter 1 of the Patent Cooperation Treaty), dated Jan. 21, 2016, 11 pages.

(Continued)

*Primary Examiner* — Douglas Godbold
(74) *Attorney, Agent, or Firm* — Daly, Crowley, Mofford & Durkee, LLP

(57) ABSTRACT

Methods and apparatus for dynamically suppressing low frequency non-speech audio events, such as road bumps, without suppressing speech formants. In exemplary embodiments of the invention, maximum powers in first and second windows are computed and used to determine whether dampening should be applied, and if so, to what extent.

18 Claims, 12 Drawing Sheets

(56) References Cited

U.S. PATENT DOCUMENTS

| | | | | |
|---|---|---|---|---|
| 2012/0035921 | A1* | 2/2012 | Li | G10L 21/0208 704/226 |
| 2012/0127342 | A1* | 5/2012 | Ohtsuka | G10L 21/0208 348/231.4 |
| 2013/0080158 | A1 | 3/2013 | Hetherington et al. | |
| 2013/0138434 | A1* | 5/2013 | Furuta | G10L 21/0208 704/226 |

OTHER PUBLICATIONS

Notification of Transmittal of the International Search Report and the Written Opinion of the International Searching Authority, or the Declaration, PCT/US2013/049846, dated Mar. 31, 2014, 4 pages.
Written Opinion of the International Searching Authority, PCT/US2013/049846, dated Mar. 31, 2014, 9 pages.

* cited by examiner

METHODS AND APPARATUS FOR DYNAMIC LOW FREQUENCY NOISE SUPPRESSION

CROSS REFERENCE TO RELATED APPLICATIONS

This application is a National Stage application of PCT/US2013/049846 filed on Jul. 10, 2013, published in the English language on Jan. 15, 2015 as International Publication Number WO 2015/005914A1, entitled "Methods And Apparatus For Dynamic Low Frequency Noise Suppression", which is incorporated herein by reference.

BACKGROUND

As is known in the art, noise suppression in communication systems is desirable to improve the user experience. For example, mobile device communication between two or more parties is improved if the words spoken by the parties are crisp and easy to understand. Noise can make it difficult for the parties to understand what is being said by the other parties.

Conventional communication systems involving speech typically use Wiener filters to suppress stationary noise. However, the Wiener filter response is dependent upon the Signal-to-Noise Ratio (SNR) so that Wiener filters may not react with sufficient quickness to adequately suppress non-stationary noise bursts. As is known in the art, noise bursts can be problematic since it can be difficult to obtain a reliable estimate of the noise power spectral density. In addition, in conventional systems detection of relatively short bursts may be unreliable.

SUMMARY

The present invention provides methods and apparatus for speech signal enhancement by dynamically suppressing low frequency noise events without suppressing speech components. With this arrangement, noise events, such as road bumps, can be suppressed without suppressing speech formants.

In one embodiment, a speech signal enhancement system for removing noise from microphone input and providing a cleaned up output signal includes dynamic low frequency noise event suppression in accordance with exemplary embodiments of the invention. Exemplary speech signal enhancement systems can include single and/or multiple microphone systems that are useful for mobile telephone applications. While exemplary embodiments of the invention are shown and described in conjunction with particular applications, components, and processing, it is understood that embodiments of the invention are applicable to audio applications in general in which it is desirable to suppress certain low frequency noise events.

In one aspect of the invention, a method comprises: receiving an input signal, forming a first window of the input signal spanning a first frequency range, forming a second window of the input signal having a second frequency range adjacent to the first frequency range, determining information on any signal peaks in the first and second windows, computing, using a computer processor, a dampening level from the information on the signal peaks in the first and second windows, and adjusting sizes of the first and second windows until a final dampening level is determined for dynamically suppressing non-speech audio events in the input signal.

The method can further include one or more of the following features: the information on the signal peaks comprises a maximum power, the dampening level is computed using a ratio of the maximum powers in the first and second windows, the final dampening level corresponds to a maximum frequency for the first window at which a total dampening for the first window is maximized, adjusting the sizes of the first and second windows by increasing a size of the first window and increasing a size of the second window, wherein the adjusted first and second windows do not overlap and remain adjacent to each other, the final dampening level is only applied to the first window, the first and second windows are of equal size, the first frequency range has a maximum corresponding to maximum frequency for a lowest expected speech formant, forming the first and second windows to capture a first speech formant in the first window and a harmonic of the first speech formant in the second window, the non-speech audio event comprises a road bump, making a voiced/unvoiced determination frame-by-frame and selecting a maximum frequency for the first frequency range based upon the voiced/unvoiced determination, and/or limiting a maximum frequency of the second frequency range based upon a maximum fundamental frequency for speech.

In another aspect of the invention, a system comprises: a dynamic noise suppression module, comprising: a frame module to sample an input signal, a window generation module coupled to the frame module to form a first window spanning a first frequency range and a second window having a second frequency range adjacent to the first frequency range and to adjust the first and second windows, a power module to determine signal peak information for the first window and for the second window, and a dampening computation module to compute a dampening level corresponding to the signal peak information in the first and second windows for suppressing non-speech audio events in the input signal.

The system can further include one or more of the following features: the dampening computation module can compute the dampening level using a ratio of the maximum powers in the first and second windows, a window generation module can adjust the sizes of the first and second windows by increasing a size of the first frequency range and increasing a size of the second window, wherein the adjusted first and second windows do not overlap and remain adjacent to each other, and/or the window generation module can form the first and second windows to capture a first speech formant in the first window and a harmonic of the first speech formant in the second window. In one embodiment, the start of the second window is selected to contain at least the highest harmonic component of the lowest formant to avoid dampening of the formant to background noise level. The first window is selected to end up to slightly below the frequency at which the highest harmonic of the lowermost formant is expected.

In a further aspect of the invention, an article comprises: at least one computer readable medium including non-transitory stored instructions that enable a machine to: receive an input signal, form a first window spanning a first frequency range, form a second window having a second frequency range adjacent to the first frequency range, determine information on any signal peaks in the first and second windows, compute, using a computer processor, a dampening level from the information on the signal peaks in the first and second windows, and adjust sizes of the first and second windows until a final dampening level is determined for suppressing non-speech audio events in the input signal.

The article can further include instructions for computing the dampening level using a ratio of maximum powers in the first and second windows, and or instructions for adjusting the sizes of the first and second windows by increasing a size of the first frequency range and increasing a size of the second window, wherein the adjusted first and second windows do not overlap and remain adjacent to each other.

BRIEF DESCRIPTION OF THE DRAWINGS

The foregoing features of this invention, as well as the invention itself, may be more fully understood from the following description of the drawings in which.

DETAILED DESCRIPTION

Figure 1:
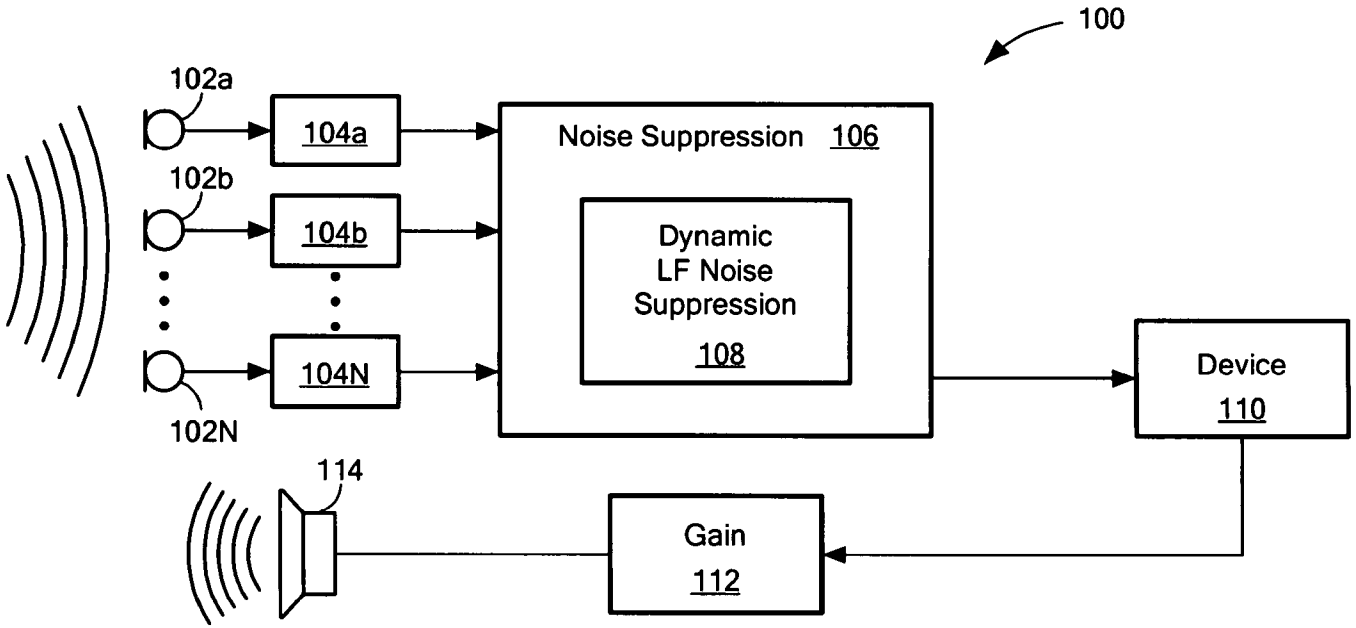
FIG. 1 is a schematic representation of an exemplary speech signal enhancement system having dynamic low frequency noise suppression in accordance with exemplary embodiments of the invention.

FIG. 1 shows an exemplary communication system 100 having dynamic low frequency noise suppression in accordance with exemplary embodiments of the invention. A microphone array 102 includes one or more microphones 102*a*-N receives sound information, such as speech from a human speaker. It is understood that any practical number of microphones 102 can be used to form a microphone array. Respective pre-processing modules 104*a*-N can process information from the microphones 102*a*-N. Exemplary pre-processing modules 104 can include echo cancellation, and the like.

A noise suppression module 106 receives the pre-processed information from the microphone array 102 and removes noise. In an exemplary embodiment, the noise suppression module 106 includes a dynamic low frequency noise suppression module 108 to suppress relatively short non-stationary noise bursts, such as road bumps.

In one embodiment, the noise suppression module 106 provides a reduced noise signal to a user device 110, such as a mobile telephone. A gain module 112 can receive an output from the device 110 to amplify the signal for a loudspeaker 114 or other sound transducer.

Figure 1A:
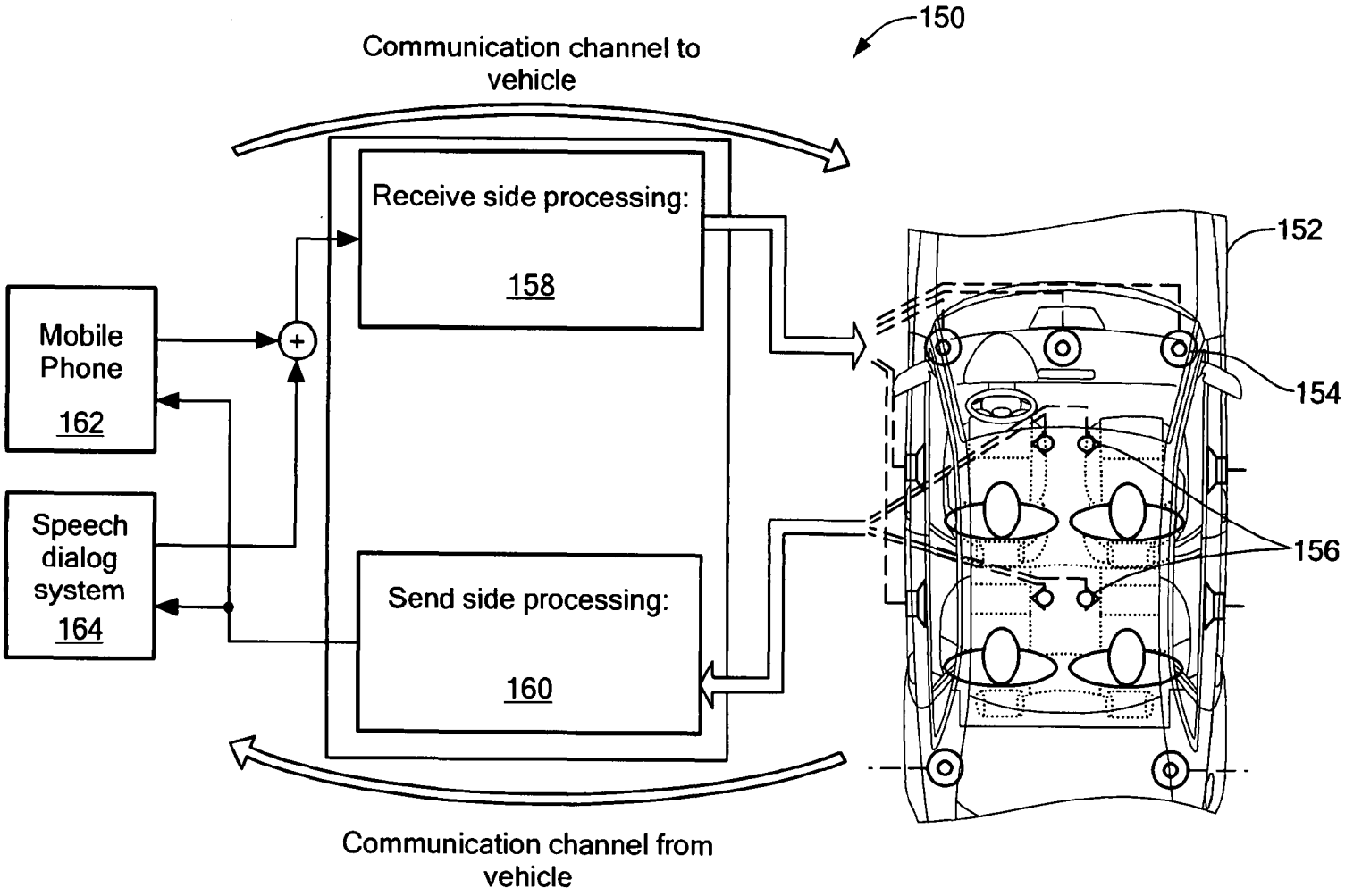
FIG. 1A is a schematic representation of an exemplary vehicle having a speech signal enhancement system in accordance with exemplary embodiments of the invention.

FIG. 1A shows an exemplary speech signal enhancement system 150 for an automotive application. A vehicle 152 includes a series of speakers 154 and microphones 156 within the passenger compartment. The system 150 can include a receive side processing module 158, which can include gain control, equalization, limiting, etc., and a send side processing module 160, which can include noise suppression, such as the noise suppression module 106 of FIG. 1, echo suppression, gain control, etc. It is understood that the terms receive side and send side are relative to the illustrated embodiment and should not be construed as limiting in any way. A mobile device 162 can be coupled to the speech signal enhancement system 150 along with an optional speech dialog system 164.

Figure 2:
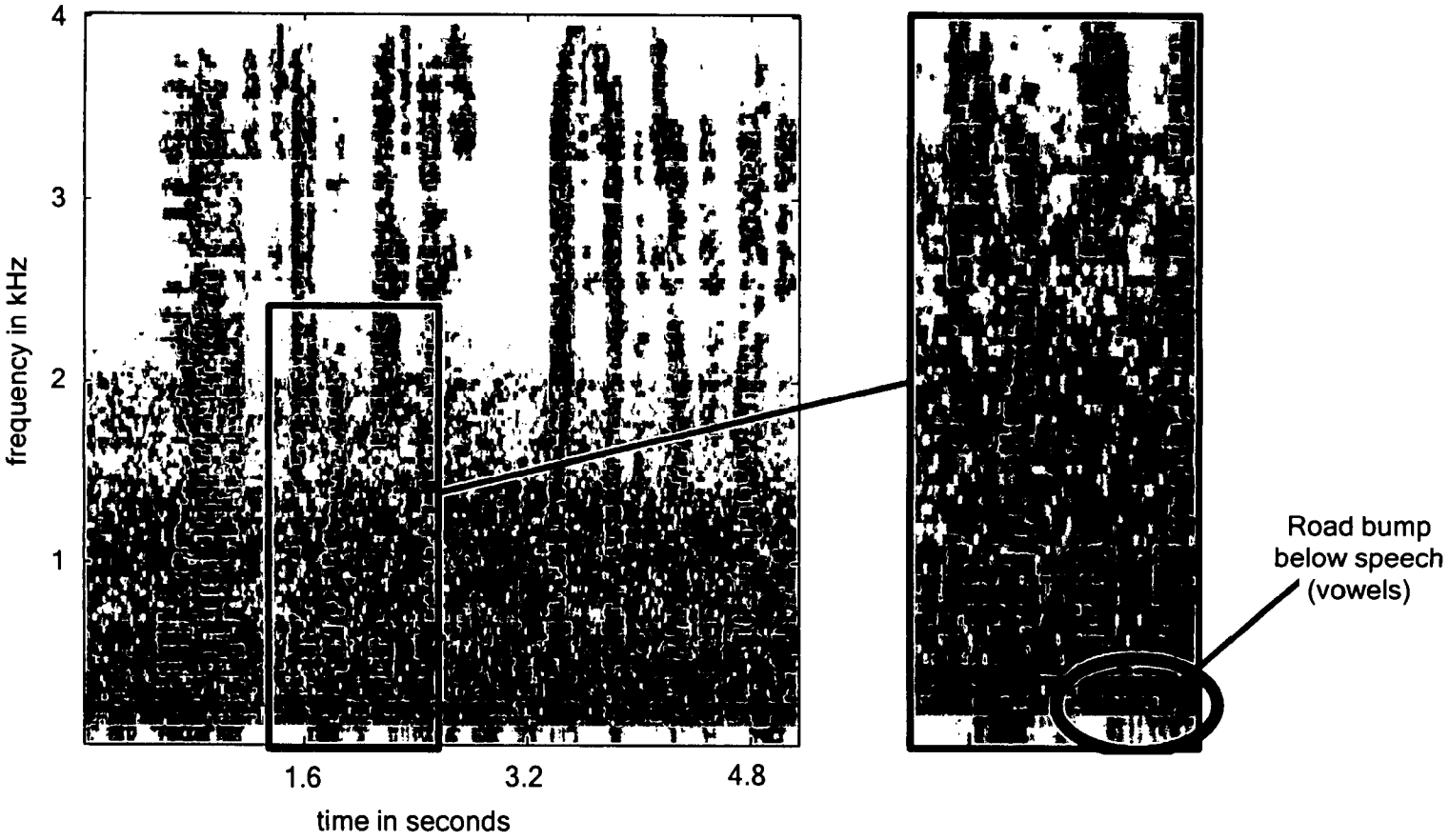
FIG. 2 is a depiction of an audio input signal having speech and non-speech components.
Figure 3:
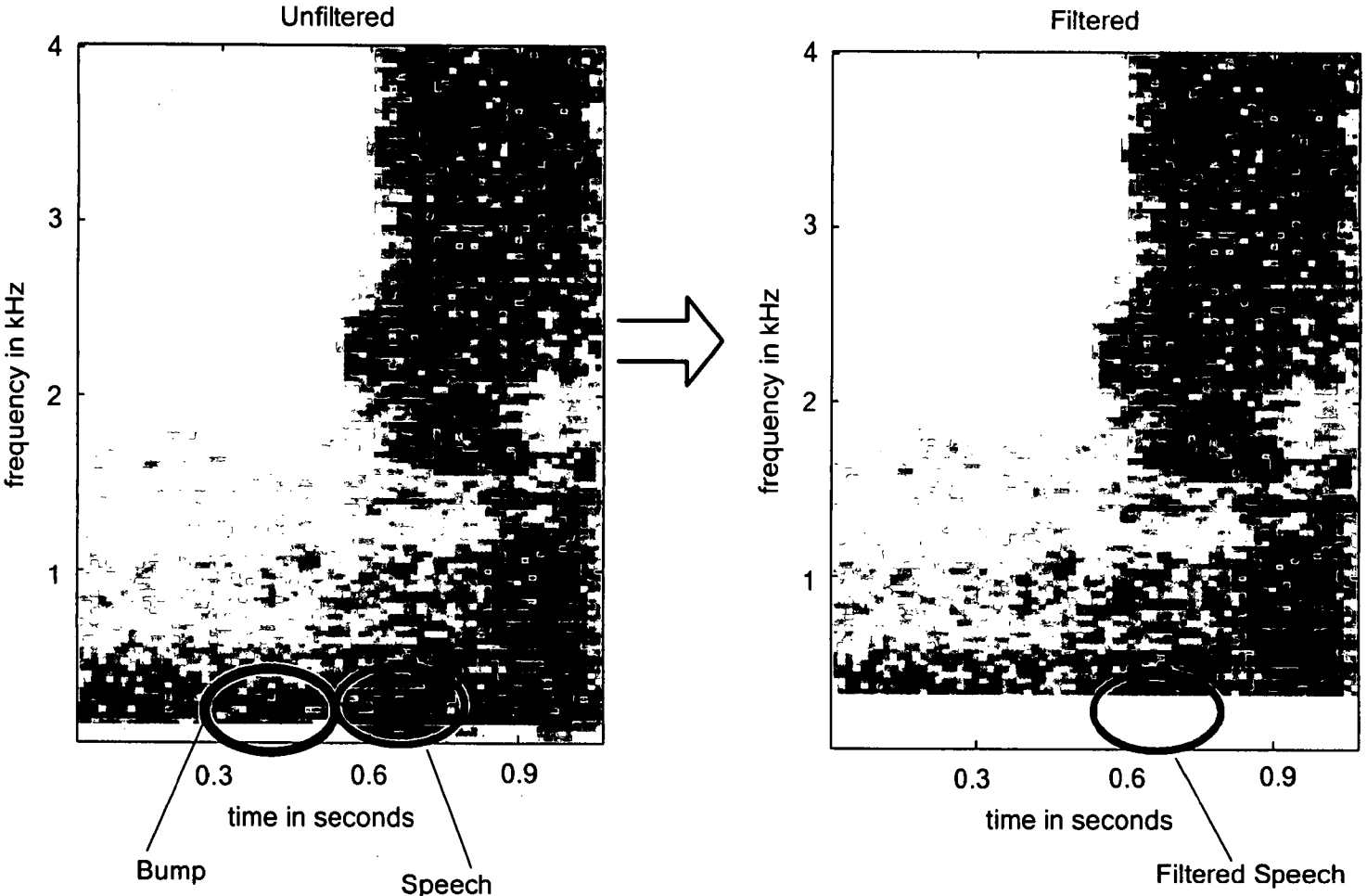
FIG. 3 PRIOR ART
FIG. 3 is a depiction of an audio signal before and after prior art high pass filtering.

It is understood that it is desirable to remove noises associated with audio events, such as road bumps, without removing speech components. Relatively low frequency audio events, such as road bumps, are often located below the visible part of the human speech harmonics structure, as shown in FIG. 2. It is understood that visible parts of speech harmonics refer to parts that are not masked by noise. While suppressing all frequencies below a given threshold, such as by using a high pass filter, may remove low frequency audio events, low frequency components of the speech harmonics may also be suppressed, as shown in FIG. 3. In accordance with exemplary embodiments of the invention, it is desirable to dynamically suppress low frequency audio events, such as road bumps, that are not speech components.

In an exemplary embodiment, an input signal, such as from a microphone array, is processed into frames, each having a number of samples. Each frame is analyzed to determine whether speech is present in the frame. In a speech-based embodiment, the sampling rate can be in the order of 8 kHz. Using a Fast Fourier Transform (FFT), about 129 frequency bins can be generated. In an alternative embodiment, a filterbank may be used to obtain a frequency domain representation. A window for identifying speech components, which is described more fully below, can initially include in the order of 2-3 frequency bins. It is understood that any practical sampling rate and number of frequency bins can be used to meet the requirements of a particular application.

Figure 4A:
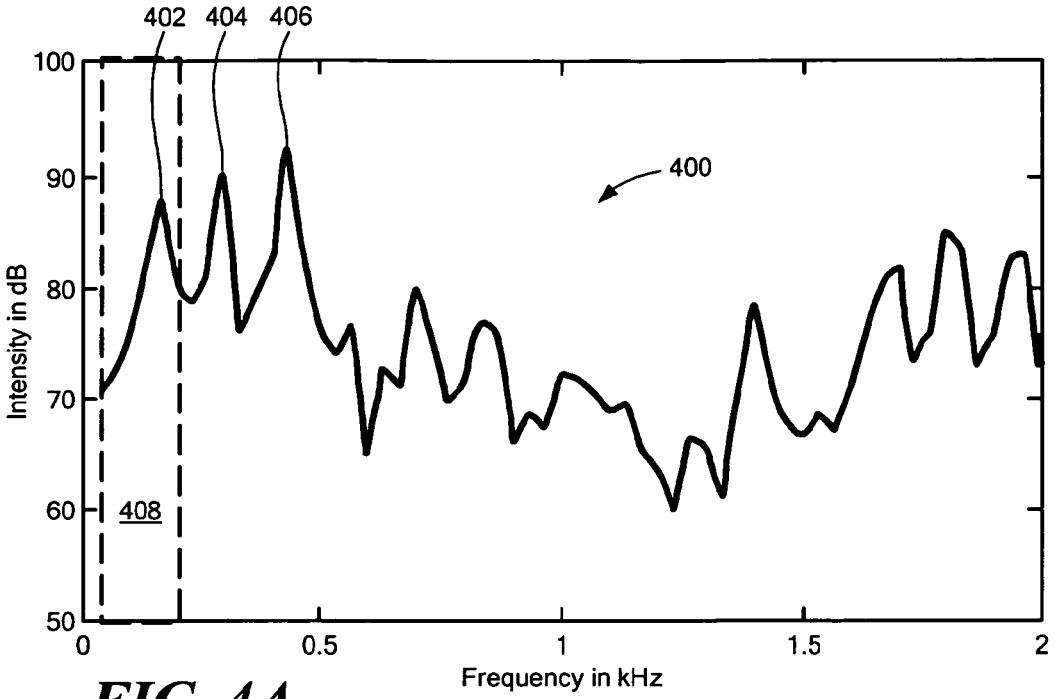
FIG. 4A is a graphical representation of signal frequency versus intensity with a first window.

FIG. 4A shows an exemplary plot 400 of sound intensity (in dB) versus frequency (in kHz). As can be seen, the plot 400 includes a first peak 402 at about 160 Hz, a second peak 404 at about 320 Hz, and a third peak 406 at about 480 Hz. The second peak 404 has a higher intensity than the first peak 402, and the third peak 406 has a higher intensity than the second peak 404. The illustrative plot 400 is indicative of speech having a fundamental frequency and harmonic components.

In exemplary embodiments of the invention, initial first and second windows, which are described more fully below, are selected to evaluate the frequency and intensity information for identifying whether speech is present or whether a noise event is present. In general, speech should not be filtered while noise events should be dampened to improve the speech quality heard by users. The first and second windows are then adjusted to evaluate the peaks, if any, in the signal from the microphone array to determine whether speech is present or whether a low frequency noise event is present that should be dampened.

Referring again to the illustrative plot 400 in FIG. 4A, a first window 408 is generated. In general, the first window 408 is selected to determine whether the content in the first window is part of a formant (i.e. a speech harmonics structure) or whether it is noise (i.e. a road bump). In one embodiment, the first window starts with the lowest frequency (bin 1, corresponding to about 31.25 Hertz at a window length of 256 and sampling rate of 8 kHz). The initial maximum frequency of the first window is set to the minimum expected fundamental frequency or a value slightly below this.

Figure 4B:
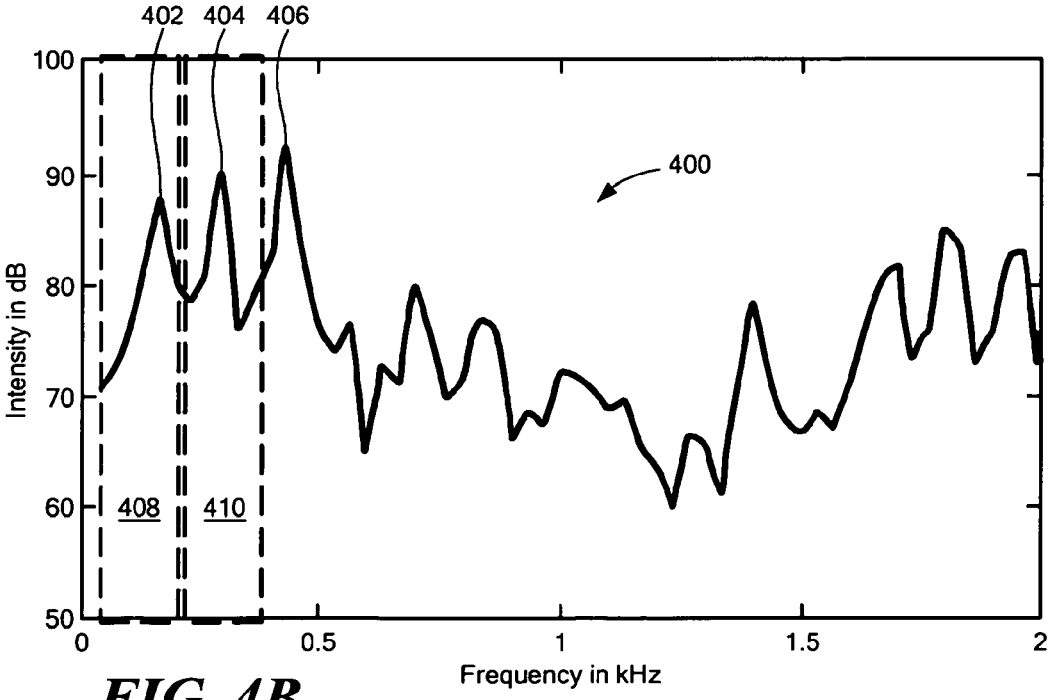
FIG. 4B is a graphical representation of FIG. 4A with a second window added.

An exemplary window size is 2-3 frequency bins. The voiced speech of a typical adult male has a fundamental frequency from about 85 to about 180 Hz and the voiced speech of a typical adult female has a fundamental frequency from about 165 to about 270 Hz. In the illustrated embodiment, the first window begins at about 30 Hz and ends at about 216 Hz. The first window 408 starts at a frequency corresponding to a lowest fundamental frequency that is expected, here selected to be 30 Hz. As shown in FIG. 4B, a second window 410 is selected to start in the frequency bin after the last bin of the first window 408 and end at about 432 Hz. In the illustrated embodiment, the second window 410 is the same size as the first window 408.

It should be noted that if a first speech harmonic component, such as the first peak 402, is in the first window 408, a second harmonic component will be contained in the second window 410 due to the harmonic nature of the speech formants and the initial window frequencies. For example, if a fundamental frequency is 100 Hz, the second harmonic frequency is 200 Hz, and third harmonic frequency is 300 Hz ($f_n=nf_0$), and so on.

It is understood that there is an assumption that each harmonic increases in power, i.e., that the harmonics within a formant increase in power with increasing frequency, or at least stays at the same level. Harmonics can decrease in frequency. In one embodiment, a scaling factor $\alpha$ can be used to relax assumptions or to make them more strict, as described more fully below.

In an exemplary embodiment, the second window 410 ends at frequency $K=\min(2k, k+f_{0,max})$, where $f_{0,max}$ is the maximum fundamental frequency that is expected and k is the maximum frequency in the first window. Mostly, the second window will be the same size as the first window such that $k+f_{0,max}$ does not serve to limit the end point of the second window.

Once the initial first and second windows 408, 410 are established, the maximum power $P_L$, $P_U$ of the respective first (lower) and second (upper) windows is computed as follows:

$$P_L=\max\{P_{XX}(l),\ l=1,\ldots,k\}$$

$$P_U=\max\{P_{XX}(l),\ k+l=1,\ldots,K\}$$

In the plot 400 of FIG. 4B, the maximum power of the first window is about 87 dB and the maximum power of the second window is about 90 dB. That is, the first peak 402 is about 87 dB and the second peak 404 is about 90 dB.

The maximum power for the peaks can then be used to compute a dampening factor. In one embodiment, the dampening factor can be defined as set forth below:

$$\tilde{H}_k(l)=\begin{cases}\min(P_U/P_L,1) & l\in\{1,\ldots,k\}\\ 1 & \text{otherwise}\end{cases}$$

where 1 indicates no dampening. In an exemplary embodiment, the dampening factor is determined and held constant for the entire window length.

Where the second peak 404, which is located in the second window 410 in FIG. 4B, has a higher power than the first peak 402 in the first window 408, the ratio of $P_U/P_L$ is greater than one, the dampening factor is 1, i.e., no dampening. That is, where the second peak 404 in the second window 410 is greater than first peak 402 in the first window 408, which is indicative of speech being present, then no dampening occurs. It is understood that taking the minimum for the dampening computation prevents amplification of low frequency content. That is, only attenuation is allowed. In one embodiment, only the first window is dampened with no dampening outside of the first window 408.

Figure 4C:
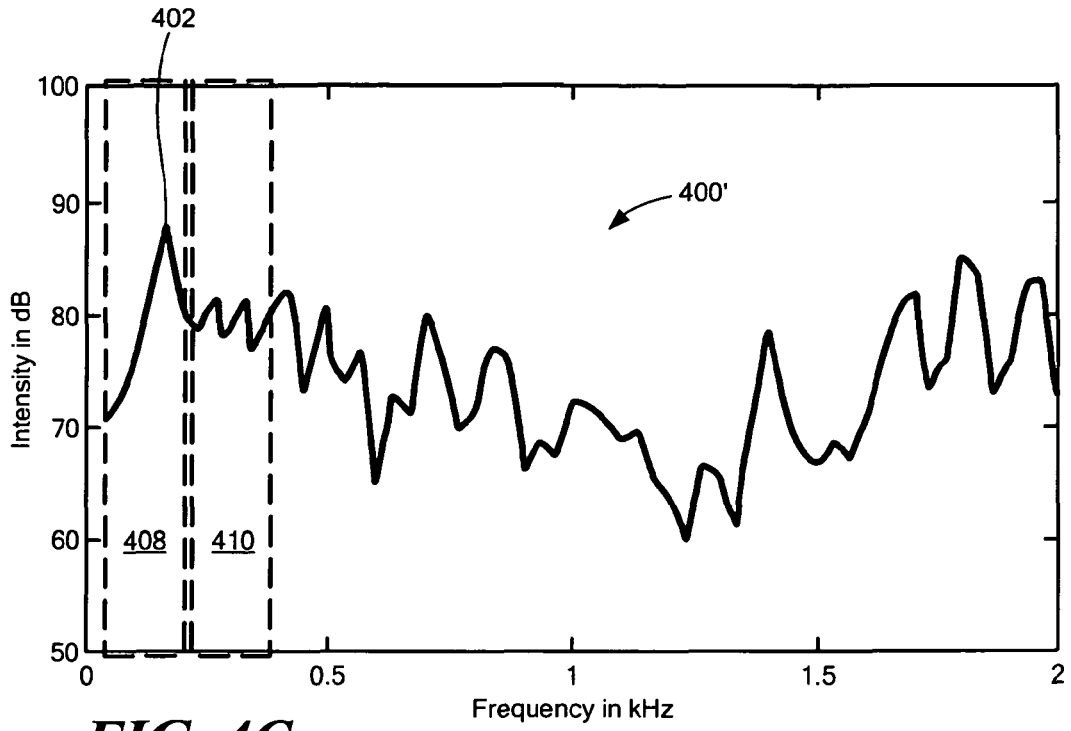
FIG. 4C is a graphical representation of FIG. 4B with peaks removed.

FIG. 4C shows the plot 400' of FIGS. 4A and 4B with the second and third peaks removed. This pattern is indicative of a non-speech audio event since harmonic multiples of the first peak 402 are not present. It is understood that the first peak is a harmonic component itself and that the first three peaks (when the second and third peaks are not removed) constitute a formant. Looking at the maximum power in the first and second windows 408, 410, the ratio $P_U/P_L$ is less than 1, so that the first window 408 will be dampened.

After generating the initial first and second windows 408, 410 and computing the dampening factor, the sizes of the first and second windows 408, 410 are then adjusted to determine if the dampening is optimized based upon the location of the peaks (if any). In an exemplary embodiment, the first window size is increased by one frequency bin, the second window start frequency is moved up one frequency bin and also increased by one frequency bin on the end. The dampening factor is re-computed for the new windows. The process of increasing the first and second window sizes and re-computing the dampening is repeated until stopping at a maximum frequency $k_{max}$, which is chosen in such a way that speech is not suppressed, as described above. In an exemplary embodiment total dampening is maximized, as set forth below:

$$\tilde{H}(l)=\min\{\tilde{H}_k(l),\ k=1,\ldots k_{max}\}$$

It is understood that minimum coefficients provide maximum dampening. It is desired to maximize dampening in each frequency bin based on the relationships set forth above.

As this maximum frequency $k_{max}$ is different for voiced speech (e.g. vowels such as u, o, a, e, i which have a distinct harmonics structure) and unvoiced speech (e.g. fricatives such as sh, f, z which do not have a distinct harmonics structure), a harmonicity detector can be used for a voiced/unvoiced decision. It is understood that a harmonicity detector is to be contrasted with a voice activity detector, which typically distinguishes between speech and non-speech.

As noted above, the initial sizes of the first and second windows may be off in relation to the speech components. For example, while the initial first and second windows may be located in such a way that speech formants are located in the first and second windows for speech from a baritone man, the initial windows may not be located correctly for speech formants for a relatively high-pitched woman.

Figure 5:
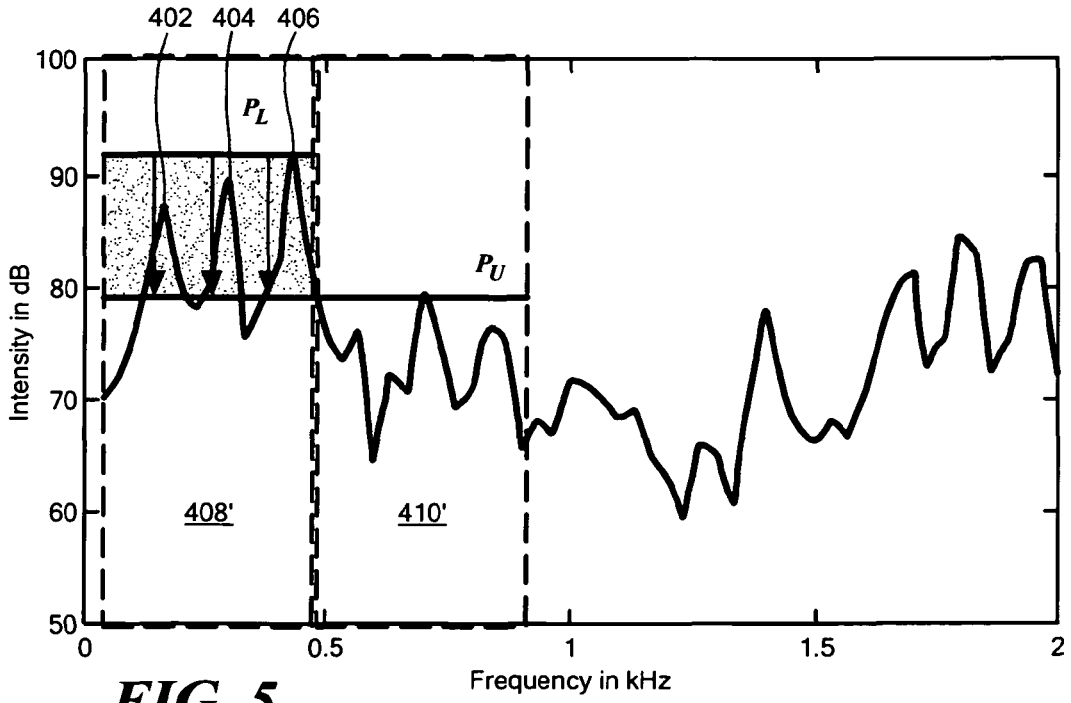
FIG. 5 is a graphical representation of signal frequency versus intensity with improperly selected first and second windows.

As shown in FIG. 5, if the windows become too large, speech harmonics may be cancelled. In the illustrated embodiment, the first window 408' begins at about 60 Hz and ends at about 500 Hz and the second window 410' begins at about 501 Hz and ends at about 850 Hz. The maximum power of the first window 408' is greater than the maximum power of the second window ($P_U/P_L<1$) so that the peaks 402, 404, 406 in the first window 408' are dampened. However, since the peaks 402, 404, 406 in the first window are speech components, the first window 408' should not be dampened.

In general, the beginning of the lowermost formant of human speech is not known and is difficult to estimate in noise. In addition, the frequency of low frequency audio events, such as road bumps, is not known since such events can vary in time and can cover a relatively large frequency range. In general, noise events are not harmonic in nature and can be differentiated from speech, which does have harmonic components.

Once the dampening is determined, dampening across the first window can be applied directly by multiplying the noisy speech spectrum Y(l) with the dampening coefficients, as set forth below:

$$X_1(l)=\tilde{H}(l)\cdot Y(l)$$

In another embodiment, dampening can be combined with other noise suppression or other processing. For example, dampening coefficients may be combined with Wiener noise suppression as follows:

$$X_2(l)=\tilde{H}(l)\cdot H(l)\cdot Y(l),$$

where H(l) refers to Wiener or other filter coefficients.

In another embodiment, a scaling factor $\alpha$ can be used to adjust dampening as desired:

$$\tilde{H}_k(l)=\begin{cases}\min(\alpha\cdot P_U/P_L,\ 1) & l\in\{1,\ \ldots\ ,k\}\\ 1 & \text{otherwise}\end{cases}$$

The scaling factor can be used to control the aggressiveness of the dampening. Using a factor larger than 1 decreases the dampening and using a factor smaller than one increases the dampening. This allows a trade-off between stronger (e.g., more aggressive) bump suppression with a factor smaller than 1 and less aggressive bump removal (and more speech protection) with a factor larger than 1.

Scaling factors may be chosen differently for different filter coefficients in accordance with a generic representation as:

$$\tilde{H}_k(l)=\begin{cases}\min(\alpha(P_U/P_L)^{\beta},\ 1) & l\in\{1,\ \ldots\ ,k\}\\ 1 & \text{otherwise}\end{cases}$$

where $\beta$ is an exponential scaling factor. Where $\beta$ is 0.5 for example, and $\alpha$ is 1, then $$\tilde{H}_k(l)=\begin{cases}\min\left(\sqrt{(P_U/P_L)},\ 1\right) & l\in\{1,\ \ldots\ ,k\}\\ 1 & \text{otherwise}\end{cases}$$

With regard to aggressiveness of the scaling, $\alpha_{k,l}$ can be used instead of $\alpha$ to enable the scaling to be chosen differently for different k,l. In an exemplary embodiment, dampening can be defined as:

$$\tilde{H}_k(l)=\begin{cases}\min(\alpha_{k,l}(P_U/P_L)^{\beta},\ 1) & l\in\{1,\ \ldots\ ,k\}\\ 1 & \text{otherwise}\end{cases}$$

with $\alpha_{k,l}=\alpha_0^{k-l+1}$. With this arrangement, the larger the distance of a bin from the first window to the second window, the stronger the dampening if $0<\alpha_0<1$ and the less the dampening if $\alpha_0>1$.

Figure 5A:
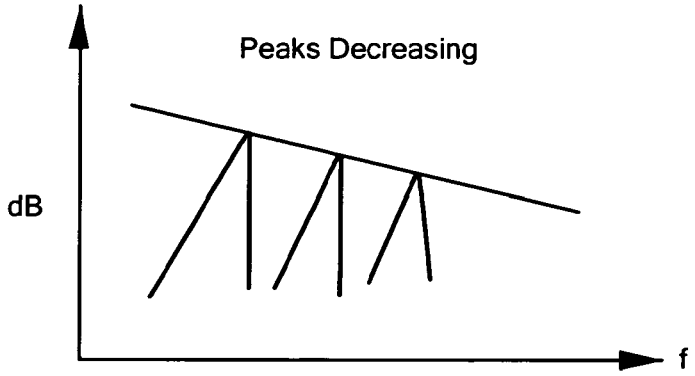
FIGS. 5A-D show exemplary peak structures for which scaling can be adjusted.
Figure 5B:
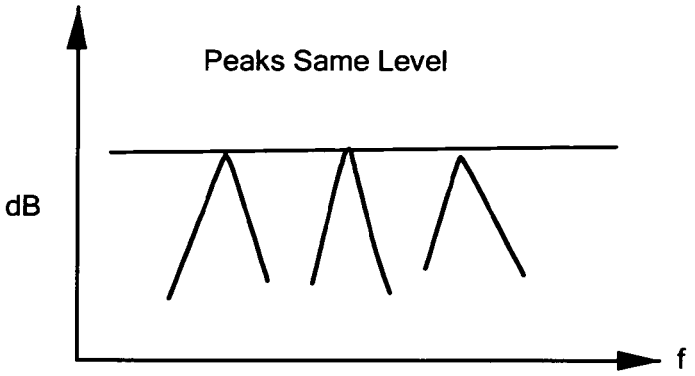
Figure 5C:
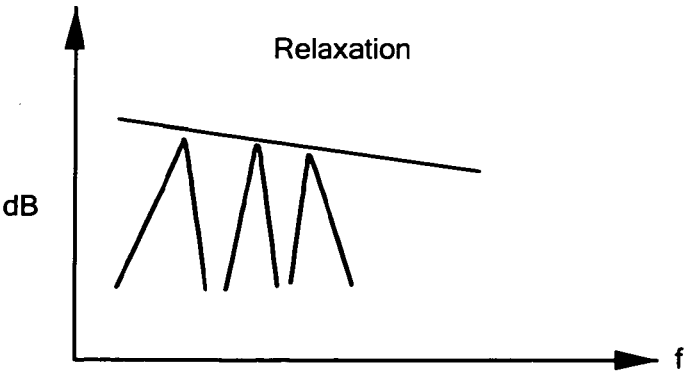
Figure 5D:
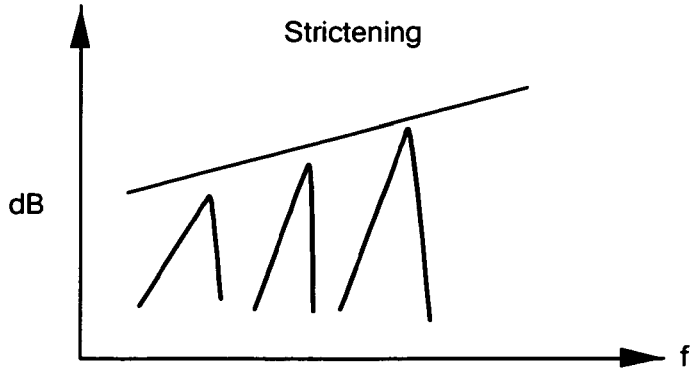

FIGS. 5A-D show various peak structures for which the scaling factor may be adjusted. FIG. 5A shows peak decreasing in intensity versus frequency. FIG. 5B shows peaks at about the same level of intensity. FIG. 5C shows peaks decreasing in intensity but with a softer slope than in FIG. 5A. Scaling can be adjusted to allow for decreasing harmonics in the formant structure, i.e., relaxation. FIG. 5D shows increasing peaks where scaling can be adjusted to enforce increasing peaks, i.e., strictening.

Figure 5E:
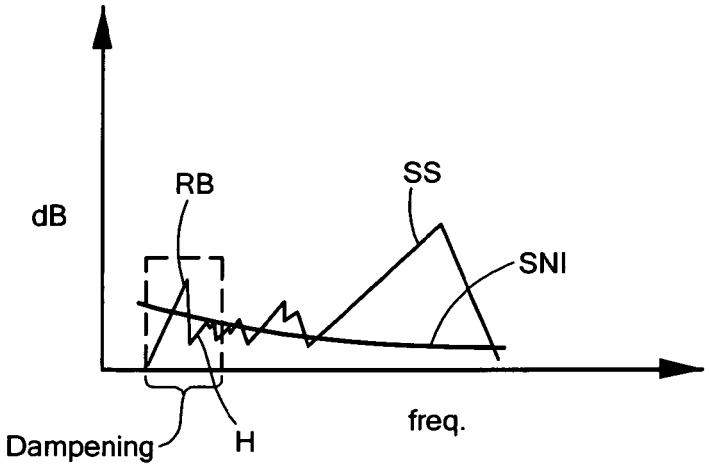
FIG. 5E is a graphical representation of a noise floor in the presence of dampening.

In exemplary embodiments of the invention, a floor can be provided by comfort noise insertion, as shown in FIG. 5E, which shows a stationary noise input SNI, a noisy input speech spectrum SS, and a dampened road bump RB. Final filter coefficients $H_k(l)$ are floored by $$\phi(l)=v\frac{|N(l)|}{|Y(l)|}$$

where v is the "spectral floor" of a Wiener filter and where |Y(l)| and |N(l)| are the (noisy input Y) signal and estimated noise (N) spectral magnitudes. Flooring refers to taking the maximum of $\tilde{H}(l)$ and $\varphi(l)$. As shown in FIG. 5A, the application of $\tilde{H}(l)$ may 'punch holes' H into the spectrum, i.e., it may go below the remaining stationary background noise after Wiener filtering, i.e., $v\cdot|N(l)|$. By flooring the filter coefficients, the resulting spectrum will be limited below by $v\cdot|N(l)|$, i.e., multiply $\varphi(l)$ by Y(l) and spectral holes are avoided.

As an alternative, noise may be simulated from $v\cdot|N(l)|$, such as by drawing complex random values which have this magnitude on average. Then $X_1(l)=\tilde{H}(l)\cdot Y(l)$ may be replaced by simulated noise values when $\tilde{H}(l)<\varphi(l)$, which can be referred to as comfort noise insertion.

Figure 6:
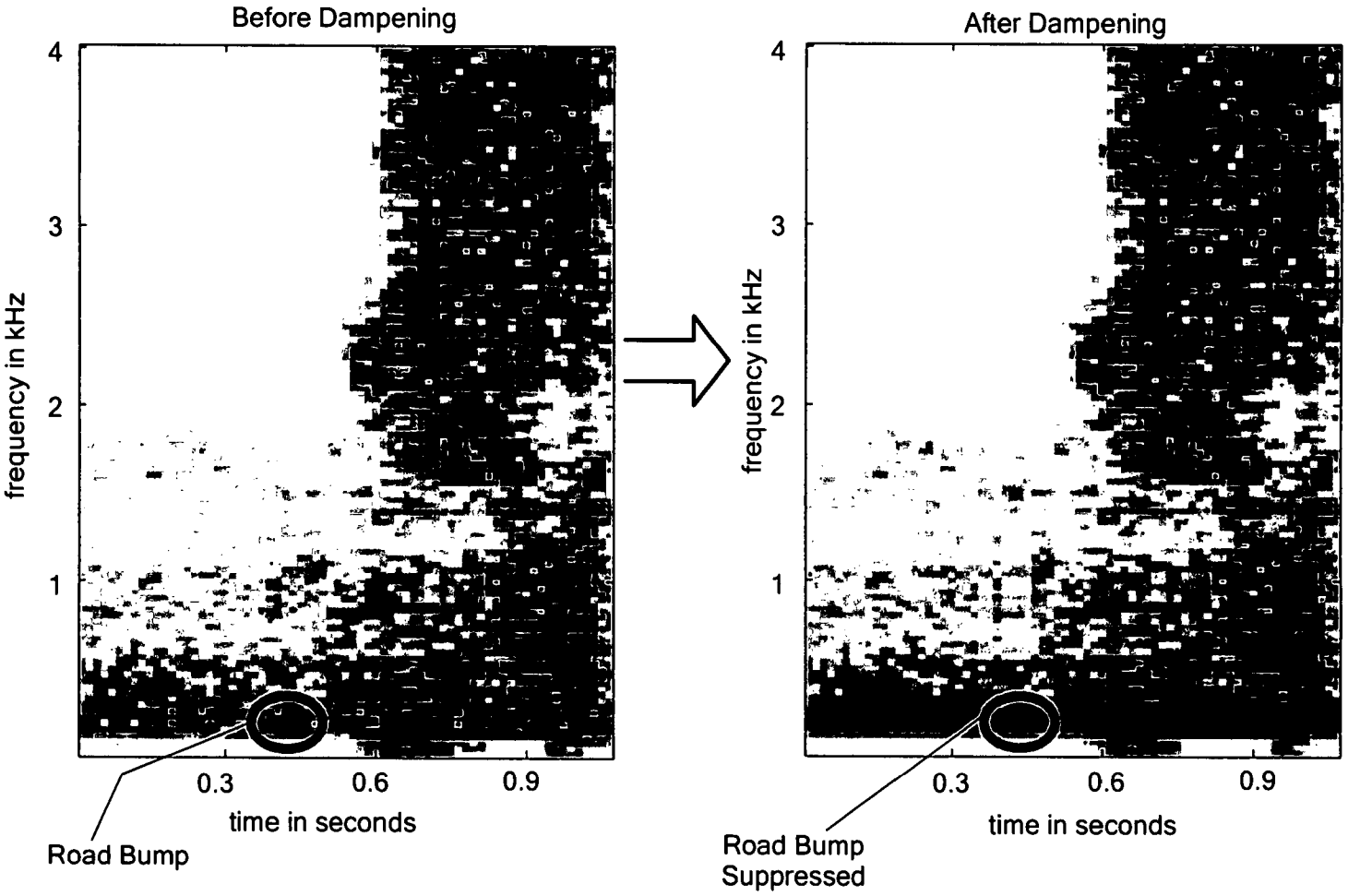
FIG. 6 is a depiction of an audio signal before dampening and after dampening in accordance with exemplary embodiments of the invention.

FIG. 6 shows an exemplary representation of frequency versus time for an illustrative audio input signal containing a road bump and speech components on the left and the audio input signal after applying dynamic noise suppression as described above. As can be seen, the road bump is dampened while speech is not dampened.

Figure 7:
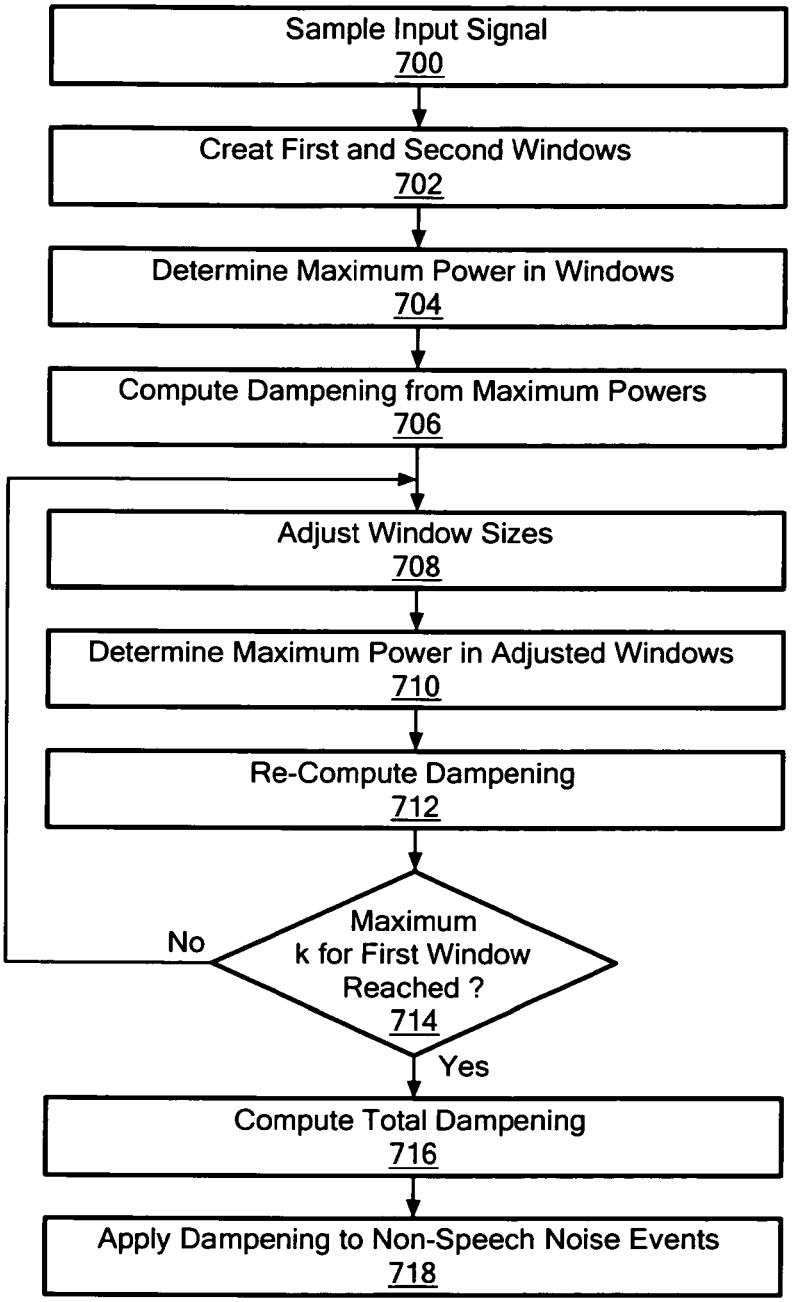
FIG. 7 is a flow diagram showing an exemplary process for implementing dynamic suppression of non-speech audio events in accordance with exemplary embodiments of the invention.

FIG. 7 shows an exemplary sequence of steps for providing dynamic low frequency noise suppression in accordance with exemplary embodiments of the invention. In step 700, an input signal is sampled. In one embodiment, signal is sampled at about 8 kHz with about 256 samples per frame. In step 702, first and second windows are created. In an exemplary embodiment, the first and second windows have respective frequency ranges that are adjacent to each other and are of the same size. In step 704, the maximum power is determined for the first and second windows. For example, the highest peak in the first window corresponds to the maximum power for that window. In step 706, a dampening level is computed from the signal information in the first and second windows. In one embodiment, a ratio of the maximum power in the first and second windows is used to determine a dampening level.

In step 708, the frequency ranges of the first and second windows are adjusted, such as by increasing a maximum frequency of the first window and increasing a maximum frequency of the second window while keeping the windows adjacent to each other and not overlapping. In step 710, the maximum powers in the adjusted first and second windows are computed and in step 712 the dampening level is re-computed.

In step 714, it is determined whether the maximum frequency for the first window to achieve maximum suppression is reached. If not, processing continues in step 708. If so, in step 716, the total dampening is computed. In step 718, dampening is applied to non-speech noise events, such as road bumps.

Figure 7A:
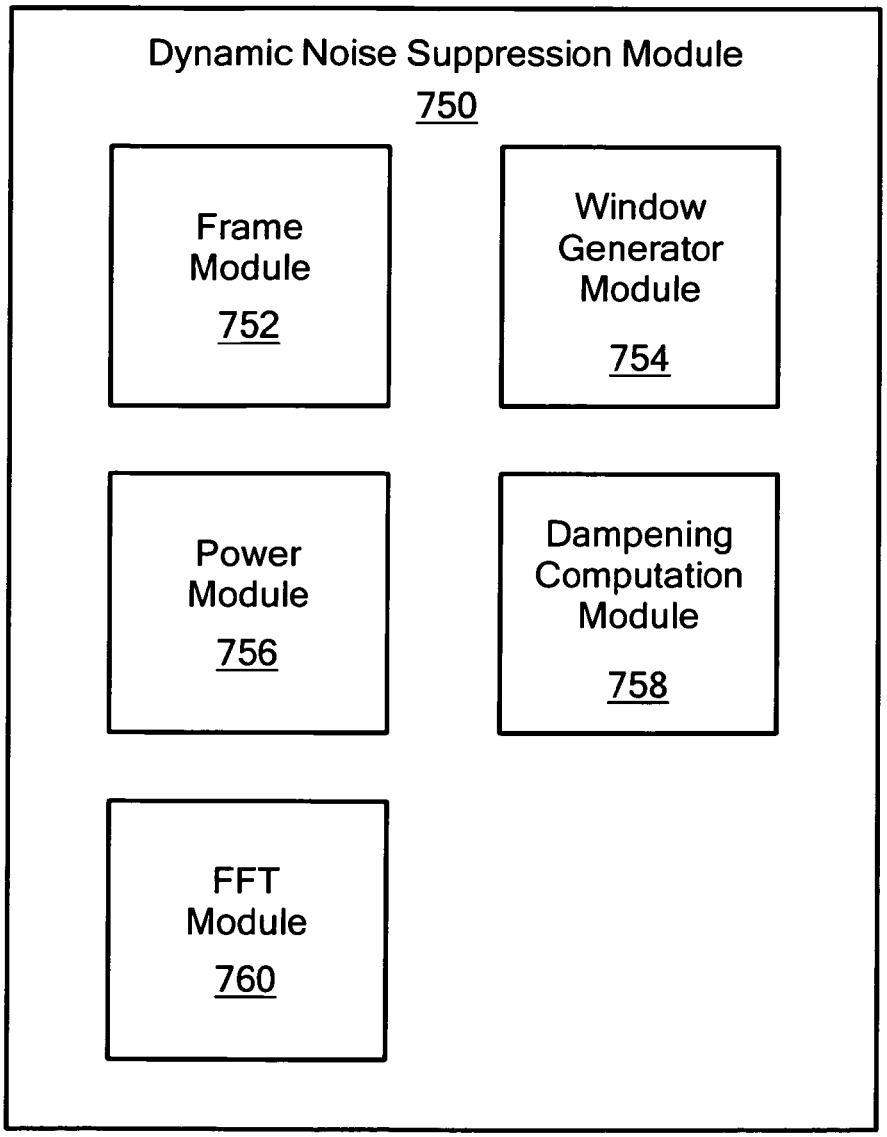
FIG. 7A is a functional block diagram of an exemplary implementation of a dynamic noise suppression module in accordance with exemplary embodiments of the invention.

FIG. 7A shows an exemplary implementation of a dynamic noise suppression module 750 in accordance with exemplary embodiments of the invention. The dynamic noise suppression module 750 includes a frame module to sample an input signal and break the signal into frames, such as 256 samples per frame. A window generator module 754 forms first and second windows having respective initial frequency ranges. In an exemplary embodiment, the first window has a maximum frequency $k_{max}$ at which dampening computations terminate, as described above. The first window frequency can go slightly below the lowermost speech formant that is expected, as it is desirable to have the uppermost harmonic of the formant to be in the second window (provided it is this formant). In an exemplary implementation, the expected maximum frequency of a lowermost speech formant is used minus half of the maximum fundamental frequency that can be expected for a speaker, i.e. f_{lowermost−formant, max}−f_{0,max}. Note that f_{lowermost−formant, max} is chosen differently for voiced/unvoiced speech as explained above. It is in the range of 300-500 hertz for voiced speech (i.e. in the presence of distinct harmonic structures) and in the range 1000-1500 Hertz for unvoiced speech (i.e. in the absence of distinct harmonic structures). In one embodiment, this decision is based on a harmonicity detector, which can distinguish between voiced/unvoiced frames. It is understood that other configurations are contemplated.

The window generator module 754 also adjusts the windows, as described above, to achieve a desired level of non-speech audio event suppression. A power module 756 obtains information on the signal in the first and second windows. In one embodiment, the power module 756 determines the maximum power of the spectrum in the first and second windows. A dampening computation module 758 determines a dampening level based on the signal information in the first and second windows, as described above. A FFT module 760 enables processing in the frequency domain.

While exemplary embodiments of the invention are shown and described as having discrete first and second windows, it is understood that additional windows can be created and that such windows can overlap with other windows. For example, additional overlapping windows can be created to confirm formant and/or noise event locations and/or presence. Also, further windows can be used for adjusting dampening coefficients within a window. Also, while determining a maximum power in a window is described, it is understood that other signal characteristics can be used to determine the presence of speech harmonic components. Further, while exemplary embodiments are shown in conjunction with speech signal enhancement for vehicles, it is understood that other embodiments can include dynamic noise suppression in any system having a microphone array, which includes one or more microphones, receiving speech in environments subject to noise, such as entertainment systems, intercom systems, laptop communication systems, and the like.

Figure 8:
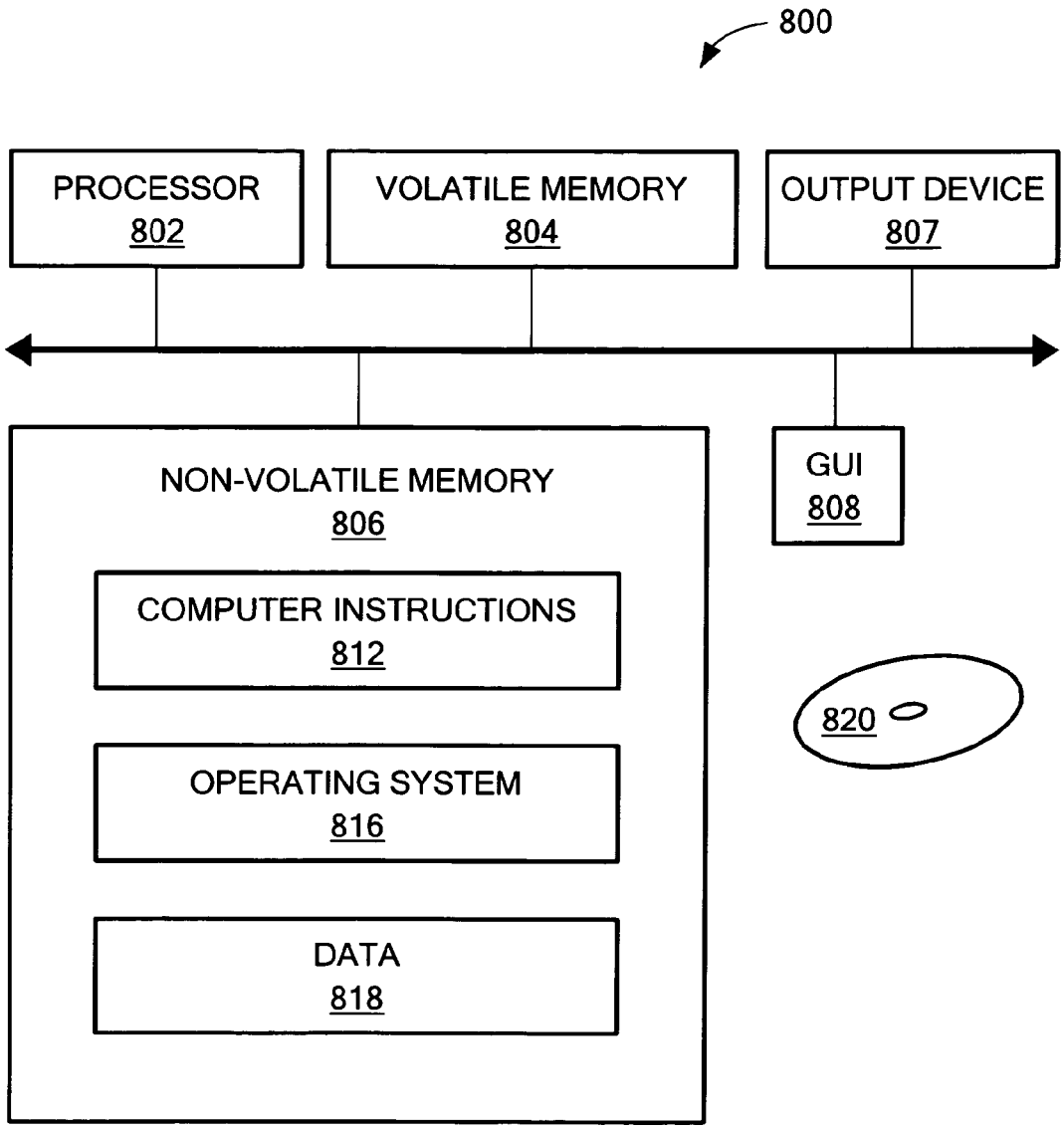
FIG. 8 is a schematic representation of an exemplary computer that performs at least a portion of the processing described herein.

FIG. 8 shows an exemplary computer 800 that can perform at least part of the processing described herein. The computer 800 includes a processor 802, a volatile memory 804, a non-volatile memory 806 (e.g., hard disk), an output device 807 and a graphical user interface (GUI) 808 (e.g., a mouse, a keyboard, a display, for example). The non-volatile memory 806 stores computer instructions 812, an operating system 816 and data 818. In one example, the computer instructions 812 are executed by the processor 802 out of volatile memory 804. In one embodiment, an article 820 comprises non-transitory computer-readable instructions.

Processing may be implemented in hardware, software, or a combination of the two. Processing may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform processing and to generate output information.

The system can perform processing, at least in part, via a computer program product, (e.g., in a machine-readable storage device), for execution by, or to control the operation of, data processing apparatus (e.g., a programmable processor, a computer, or multiple computers). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer. Processing may also be implemented as a machine-readable storage medium, configured with a computer program, where upon execution, instructions in the computer program cause the computer to operate.

Processing may be performed by one or more programmable processors executing one or more computer programs to perform the functions of the system. All or part of the system may be implemented as, special purpose logic circuitry (e.g., an FPGA (field programmable gate array) and/or an ASIC (application-specific integrated circuit)).

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A method for speech signal enhancement by dynamically suppressing low frequency noise events without suppressing speech components, comprising:

receiving an input signal;

forming a first window of the input signal spanning a first frequency range corresponding to a fundamental frequency of human voiced speech for capturing a speech formant;

forming a second window of the input signal having a second frequency range adjacent to the first frequency range;

determining information on any signal peaks in the first and second windows;

computing, using a computer processor, a dampening level from the information on the signal peaks in the first and second windows;

increasing the dampening level of the first frequency range when a harmonic of the speech formant in the first window is not detected in the second window based upon the signal peak information in the first and second windows;

adjusting sizes of the first and second windows until a final dampening level is determined for dynamically suppressing non-speech audio events in the input signal; and outputting the input signal having the final dampening level for a loudspeaker to generate sound.

2. The method according to claim 1, wherein the information on the signal peaks comprises a maximum power.

3. The method according to claim 2, wherein the dampening level is computed using a ratio of the maximum powers in the first and second windows.

4. The method according to claim 1, wherein the final dampening level corresponds to a total dampening for the first window that is maximized.

5. The method according to claim 1, further including adjusting the sizes of the first and second windows by increasing a size of the first window and increasing a size of the second window, wherein the adjusted first and second windows do not overlap and remain adjacent to each other.

6. The method according to claim 1, wherein the final dampening level is only applied to the first window.

7. The method according to claim 1, wherein the first and second windows are of equal size.

8. The method according to claim 1, further including providing a background noise floor.

9. The method according to claim 1, wherein the first frequency range has a maximum corresponding to maximum frequency for a lowest expected speech formant.

10. The method according to claim 1, wherein the non-speech audio event comprises a road bump.

11. The method according to claim 1, further including making a frame-by-frame voiced/unvoiced determination and selecting a maximum frequency for the first frequency range based upon the determination of whether speech is present.

12. The method according to claim 1, further including limiting a maximum frequency of the second frequency range based upon a maximum fundamental frequency for speech.

13. A system for speech signal enhancement by dynamically suppressing low frequency noise events without suppressing speech components, comprising:

a dynamic noise suppression module, comprising:

a frame module to sample an input signal;

a window generation module coupled to the frame module to form a first window spanning a first frequency range and a second window having a second frequency range adjacent to the first frequency range and to adjust the first and second windows, wherein the first window corresponds to a fundamental frequency of human voiced speech for capturing a speech formant;

a power module to determine signal peak information for the first window and for the second window; and a dampening computation module to compute a dampening level corresponding to the signal peak information in the first and second windows for suppressing non-speech audio events in the input signal including increasing the dampening level of the first frequency range when a harmonic of the speech formant in the first window is not detected in the second window based upon the signal peak information in the first and second windows and to output the input signal having the final dampening level for a loudspeaker to generate sound.

14. The system according to claim 13, wherein the dampening computation module can compute the dampening level using a ratio of the maximum powers in the first and second windows.

15. The system according to claim 13, wherein the a window generation module can adjust the sizes of the first and second windows by increasing a size of the first frequency range and increasing a size of the second window, wherein the adjusted first and second windows do not overlap and remain adjacent to each other.

16. An article comprising:

a non-transitory computer readable medium including stored instructions that enable a machine to:

receive an input signal;

form a first window spanning a first frequency range corresponding to a fundamental frequency of human voiced speech for capturing a speech formant;

form a second window having a second frequency range adjacent to the first frequency range;

determine information on any signal peaks in the first and second windows;

compute, using a computer processor, a dampening level from the information on the signal peaks in the first and second windows;

increase the dampening level of the first frequency range when a harmonic of the speech formant in the first window is not detected in the second window based upon the signal peak information in the first and second windows;

adjust sizes of the first and second windows until a final dampening level is determined for suppressing non-speech audio events in the input signal; and output the input signal having the final dampening level for a loudspeaker to generate sound.

17. The article according to claim 16, further including instructions for computing the dampening level using a ratio of maximum powers in the first and second windows.

18. The article according to claim 16, further including instructions for adjusting the sizes of the first and second windows by increasing a size of the first frequency range and increasing a size of the second window, wherein the adjusted first and second windows do not overlap and remain adjacent to each other.

* * * * *